United States Patent [19]

Coffey et al.

[11] Patent Number: 4,989,007

[45] Date of Patent: Jan. 29, 1991

[54] PASSIVE RADAR AUGMENTED PROJECTILE (PRAP)

[75] Inventors: Clayton G. Coffey; William A. Jones, both of Medicine Hat; William H. Friend, St. Bruno, all of Canada

[73] Assignee: Her Majesty in Right of Canada, as represented by the Minister of National Defence, Canada

[21] Appl. No.: 7,656

[22] Filed: Jan. 28, 1987

[30] Foreign Application Priority Data

Feb. 10, 1986 [GB] United Kingdom ..... 8603206

[51] Int. Cl.[5] ..... H01Q 15/00

[52] U.S. Cl. ..... 342/11; 342/5; 342/187; 343/911 L

[58] Field of Search ..... 342/5, 9, 11, 8, 187; 343/911 R, 911 L

[56] References Cited

U.S. PATENT DOCUMENTS

| | | | |
|---|---|---|---|
| 2,580,921 | 1/1952 | Iams | 342/11 X |
| 3,126,544 | 3/1964 | Greatbatch, Jr. | 342/9 |
| 3,334,345 | 8/1967 | Bradford | 342/11 |
| 3,413,636 | 10/1968 | Migdal | 342/11 |
| 3,866,226 | 2/1975 | Benneche et al. | 342/11 X |
| 4,366,962 | 1/1983 | Campiel et al. | 342/11 X |

FOREIGN PATENT DOCUMENTS

| | | | |
|---|---|---|---|
| 1162277 | 2/1984 | Canada | 342/5 |

*Primary Examiner*—Thomas H. Tarcza
*Assistant Examiner*—Tod Swann
*Attorney, Agent, or Firm*—Stevens, Davis, Miller & Mosher

[57] ABSTRACT

The invention disclosed relates to gun-launched target projectiles wherein a radar-augmentor is included to increase the radar cross-section of the projectile to simulate on radar, an actual airborne threat such as aircraft and missiles. The radar augmentor comprises a base member, a uniform dielectric lens attached to said base member and a resilient support means between said base member and said lens. The dielectric lens is configured to provide a frontal radar return echo which simulates the actual airborne threat on radar.

17 Claims, 7 Drawing Sheets

PASSIVE RADAR AUGMENTED PROJECTILE (PRAP)

This invention relates to target projectiles, and in particular to an expendable gun-launched radar augmented target projectile to exercise radar systems and operators as well as permit defence systems to acquire and lock on to supersonic or high subsonic targets.

The radar targets commonly used for such training include aircraft-towed targets and reusable drones. Deployment of such systems is expensive, leading to infrequent use and the training provided is inadequate and not representative of the real battle threat. Moreover, the radar response of such targets alone is generally weak and unacceptable. To obviate this situation towed targets and drones have been provided with radar augmentation devices to increase the radar return or echo signal. Such devices include corner reflectors, Luneberg lenses and dielectric lenses.

In U.S. Pat. No. 3,334,345 of Aug. 1, 1967 in the name of W. R. Bradford, radar augmentors of the latter type are decribed. The dielectric lens described is of a uniform dielectric material, i.e. a dielectric material having a uniform dielectric constant throughout. The lens is in the shape of a prolate spheroid, having a frontal ellipsoidal refracting surface, a central cylindrical surface and a spherical rear reflecting surface which carries a reflective coating. There is no teaching or suggestion of the use of the radar augmentors in anything other than towed targets and drones.

It is an object of this invention to provide a low cost, expendable missile target which appears on radar to be an actual airborne threat.

It is a further object of this invention to provide an expendable missile target which will withstand gun-launching.

According to the invention an improved expendable gun-launched radar-augmented target projectile is provided, the improvement comprising modifying the radar cross-section (RCS) of the projectile by providing a radar augmentor assembly which increases the radar cross-section of the target projectile to simulate an actual airborne threat on radar, while maintaining aerodynamic flight stability, said radar augmentor assembly including a base member, a uniform dielectric lens attached to said base and a resilient support means between said base member and said lens which prevents spalling of the lens due to stresses induced during gun-launching, wherein said dielectric lens is configured to provide a frontal radar return echo which simulates that of the actual airborne threat on radar.

The radar cross-section is represented by the visual display a radar operator observes on a radar screen when tracking a projectile. Different projectiles produce different radar cross-sections or radar return echos. For example, a standard 5 inch calibre naval shell produces an RCS echo of $\leqq 0.001$ $m^2$ which is too small a RCS to be visible to most radars. A typical sea skimmer anti-ship missile produces an RCS of about 0.25 $m^2$. A typical fighter aircraft produces an RCS of about 2 $m^2$.

In the drawing which illustrates the embodiment of the invention:

Figure 1:
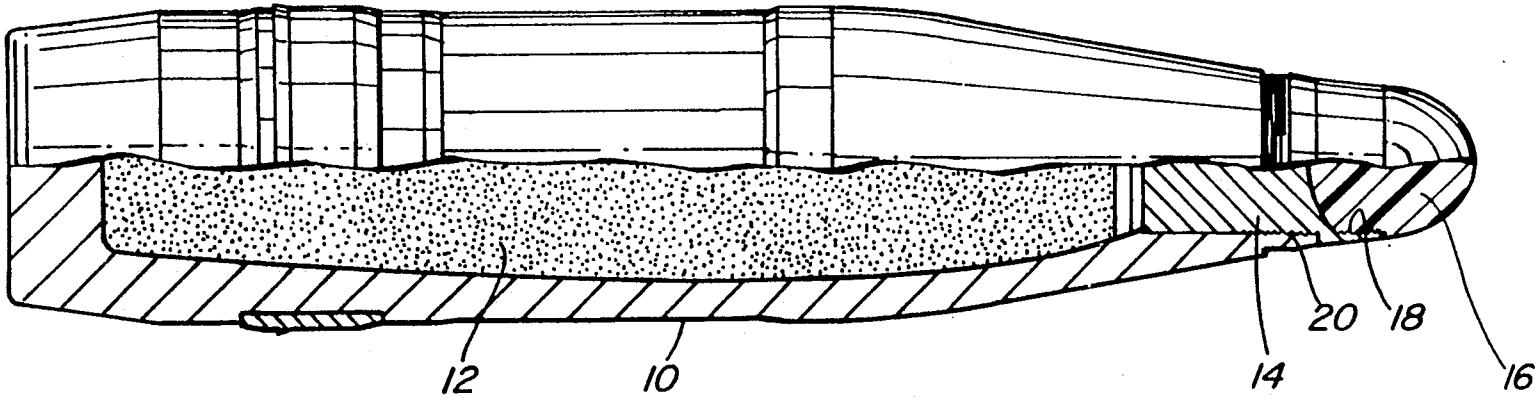
FIG. 1 is a side elevation, partly in section, of a 5"/54 calibre radar augmented target projectile (Model No. BA240) according to the invention.

As seen in FIG. 1, the radar-augmented target projectile (BA240S, wherein "S" denotes polystyrene as the uniform dielectric lens material, although other materials such as polytetraflouroethylene, polystyrene, high density polyethylene and polymethylpentene polymer (TPX®) may also be employed as will be apparent hereinafter and wherein 240 designates a 2.4 inch diameter) comprises a standard 5"/54 calibre Mk 64 hollow cylindrical BL&P projectile body 10, filled with an inert filler material 12 such as kaolin/wax. To accommodate a radar-augmentor, the fuze plug, nose fuze adapter and foam pad are removed from the standard projectile body 10 and replaced by a fuze plug replacement augmentor assembly which includes a base member 14 and a uniform dielectric lens 16. Depending upon the depth of the existing inert filler, a small quantity may have to be cut out to accommodate the base of the augmentor. The augmentor assembly is threaded directly into the nose of the projectile body 10, at 20, and the lens 16 is, in turn, threaded into the base 14, at 18.

Figure 2:
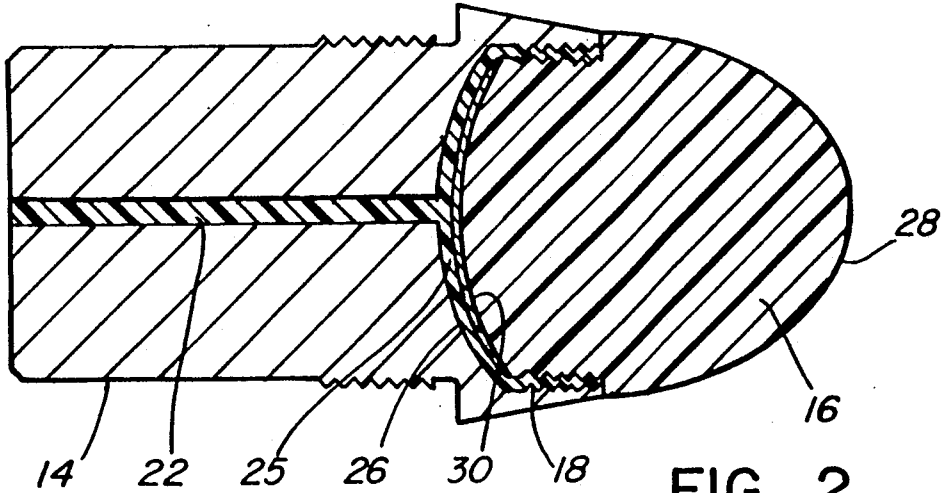
FIG. 2 is a side elevation in section of the radar augmentor assembly illustrated in FIG. 1.

As best seen in FIG. 2, the base 14 includes a central longitudinal bore 22 of uniform diameter extending therethrough. The bore 22 is filled with a suitable resilient adhesive 25 which extends through the bore 22, along the concave lens receiving recess 26 of the base 14 and along threads 18, to provide a continuous film of adhesive which assures the absence of voids between the lens 16 and base 14 preventing spalling of the lens due to the tensile stresses induced during gun-launching.

Moreover, the continuous film of adhesive provides a resilient support which minimizes the tendency of the lens becoming detached from the base during gun launch, i.e. the flexible lens tends to compress at firing and rebound upon release. This places tremendous stress at the lens/base interface which is provided for by the continuous film of resilient adhesive.

Suitable resilient adhesives include thermosetting synthetic resins such as epoxy resins and silicone resins. Epoxy resins of minimum tensile yield strength of about 4000 psi are preferred.

The method used to adapt the lens to the base is as follows. Both the lens and the base are thoroughly degreased and with the bore opening at the rear of the base covered with tape, a generous coating of adhesive is applied to the threads and lens recess. The lens is then engaged into the base threads. Once the threads are engaged, the assembly is turned so the lens is pointed down and the tape is removed. Threading together of the parts is completed in this position. Surplus adhesive from the threads and the recess is forced upward into the longitudinal bore and fills the bore. This method ensures that the lens is firmly attached and the seating of the lens to the base is free of voids. This is important from the point of view of structural integrity in such a high acceleration environment as gun launching. The adhesive is then cured in situ.

Once the lens and base are assembled it is ready to be attached to the projectile body. In the case of the BA240, the 5"/54 MK64 BL & P projectile is not modified in any way. All that is required is that the training fuze be removed and the lens and base, as a unit, be threaded into the projectile in place of the fuse. This causes the projectile to change in RCS from 0.001 $m^2$ to 0.2 $m^2$.

With specific regard to the BA240 lens itself, it is in the form of a prolate spheroid having a front ellipsoidal refracting surface portion 28 and a rear reflecting surface 30 which is metallized, typically silver-plated. Alternatively, a metal foil such as aluminum may be bonded to the lens. The diameter of the lens is about 2.4 inches.

Figure 3:
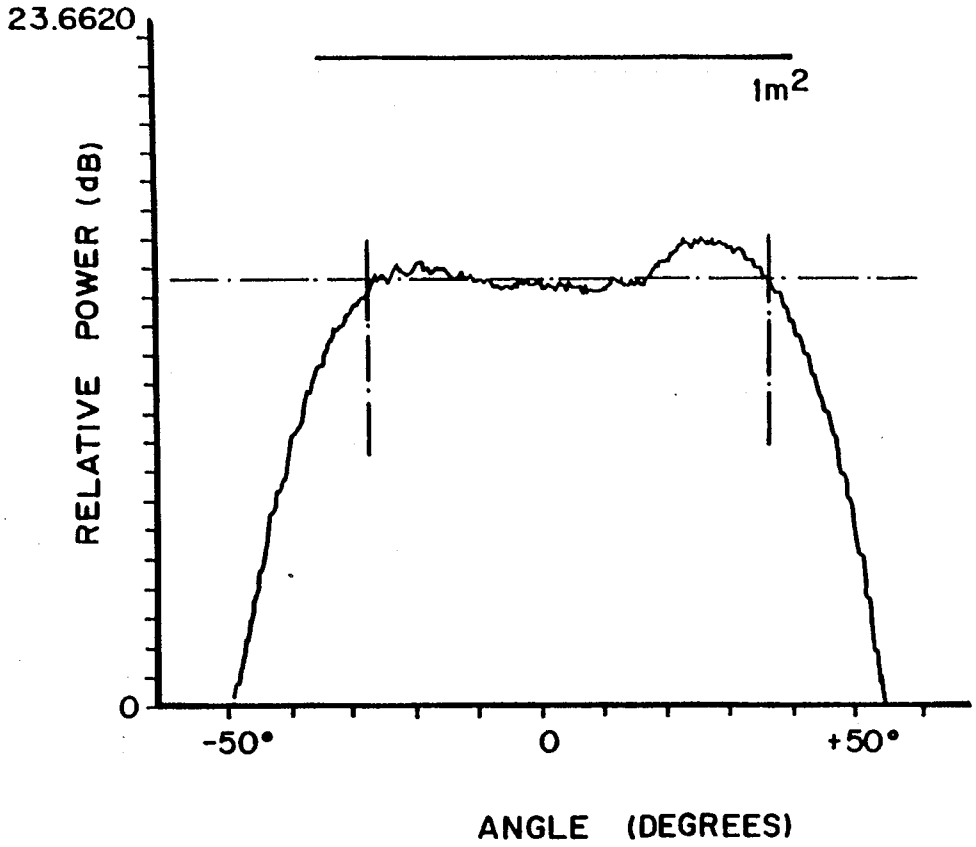
FIG. 3 is a radar cross-section (frontal x-band) of the radar-augmented target projectile illustrated in FIG. 1.

The radar cross-section (RCS) of the FIG. 1 and 2 embodiment (frontal x-band, frequency 9.37 GHz polarization verticalvertical) is presented in FIG. 3, in the form of a computer generated plot of a typical calibration run. The radar cross-section echo is seen to be essentially linear over about ±30 degrees from the centre line 0, i.e. from the longitudinal axis of the projectile at an average value of 0.2 $m^2$, i.e. about 7 dB below the 1 $m^2$ calibration level.

By way of further explanation, the accepted industrial standard for displaying RCS is in power versus angle graphs wherein power is exposed in units of decibels (dB) and angle in degrees. The relationshiip between dB and RCS, measured in meters squared ($m^2$) in our case, is a logarithmic function, i.e.

$$dB = 10 \log \frac{RCS}{RCS} \text{ reference.}$$

Expressed in another way, for each 3 dB increase or decrease, the RCS in $m^2$ is either doubled or reduced by one half.

Figure 4:
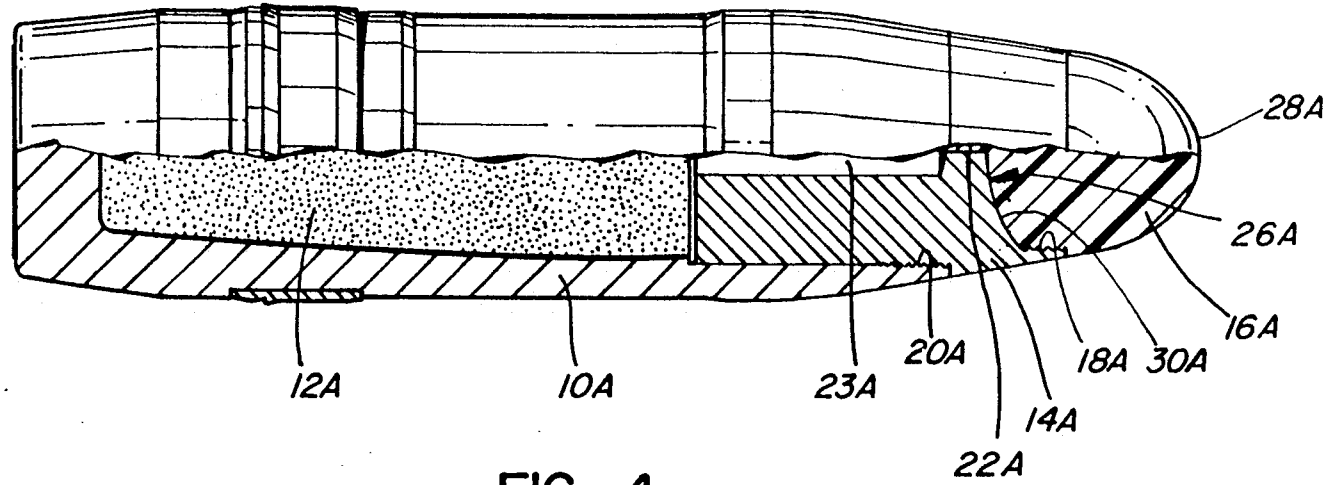
FIG. 4 is a side elevation, partly in section, of another embodiment of a 5"/54 calibre radar-augmented target projectile (Model No. BA360) according to the invention.

FIG. 4 illustrates another embodiment of a radar-augmented target projectile according to the invention (BA360S) which comprises a modified 5"/54 calibre Mk 64 BL&P hollow cylindrical projectile body 10A filled with an inert filler 12A, such as kaqlin/wax. In this embodiment, the modification of the standard projectile body involves cutting off a portion of the tapered nose section and removing sufficient inert filler to accommodate the augmentor.

As in the FIG. 1 embodiment, the augmentor assembly is threaded directly into the nose of the projectile body 10A, at 20A, and the lens 16A is, in turn, threaded into the base 14A, at 18A.

The base 14A includes a central longitudinal bore 22A of uniform diameter. In the same manner as described respecting the FIG. 2 embodiment, the bore 22A is filled with a suitable adhesive which provides a continuous film of adhesive from the threads 18A, along the concave surface 26A and through the bore 22A, to hold the lens 16A in position during the stresses induced during gun-launching. The adhesive is cured in situ.

The base 14A also includes a central cut-out 23A of larger diameter than the bore 22A for adjusting the weight of the base and the location of the centre of gravity to match those of the unmodified projectile to ensure aerodynamic flight stability of the modified projectile. Accordingly, the weight and centre of gravity of each component part is considered so that the overall requirement for aerodynamic flight stability of the projectile is met.

Referring specifically to the BA360S lens, it also is a prolate spheroid having a front ellipsoidal refracting surface portion 28A and a rear reflecting surface 30A which is typically silver-plated. The 360 designation indicates a lens diameter of about 3.6 inches and "S" indicates polystyrene.

Figure 5:
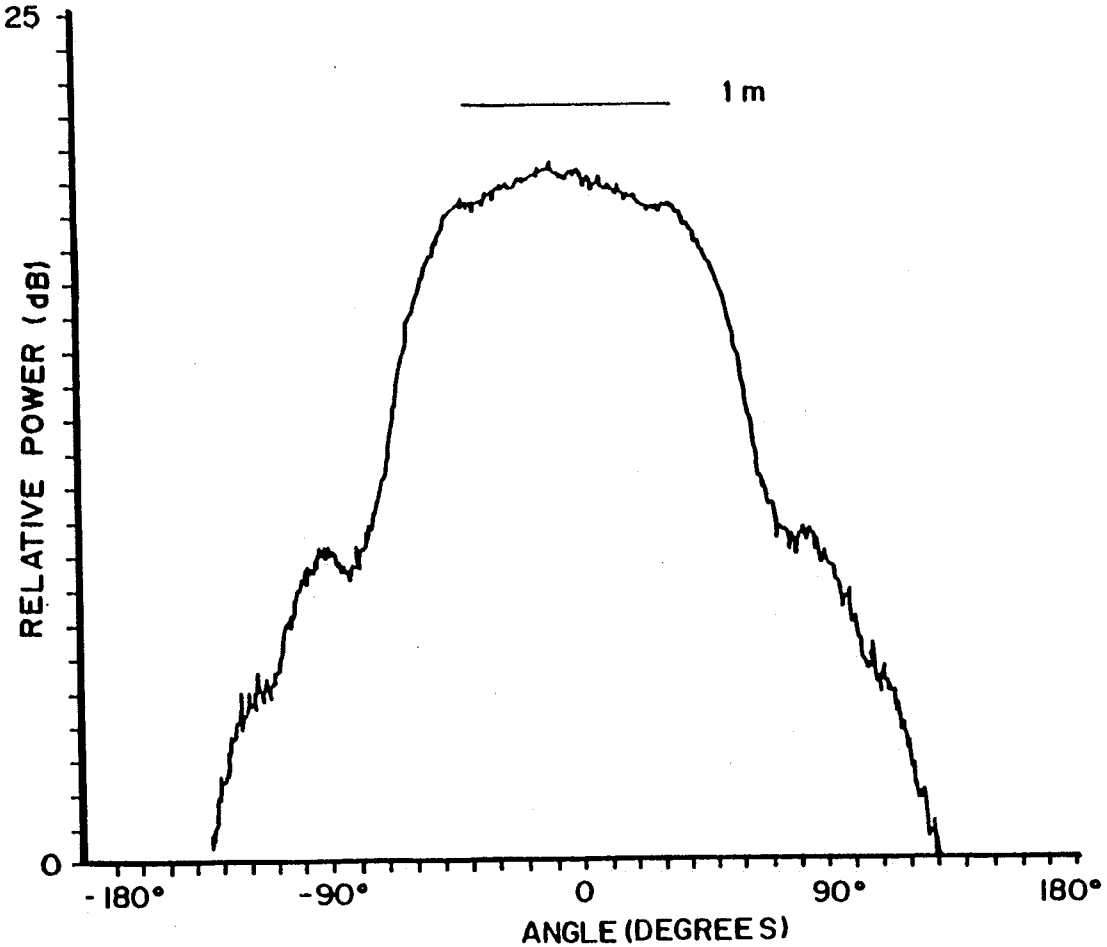
FIG. 5 is a radar cross-section (frontal x-band) of the radar-augmented target projectile illustrated in FIG. 4.

The radar cross-section of the FIG. 4 embodiment (frontal x-band, frequency 9.37 Ghz, polarization vertical-vertical) is illustrated in FIG. 5 as a computer-generated plot of a calibration run of one of the lenses test fired. The radar cross-sectional echo is seen to be linear over about ±50 degrees, symmetrical about the centre line 0, at an average value of 0.63 $m^2$, i.e. about 2 dB below the 1 $m^2$ calibration level.

Figure 6:
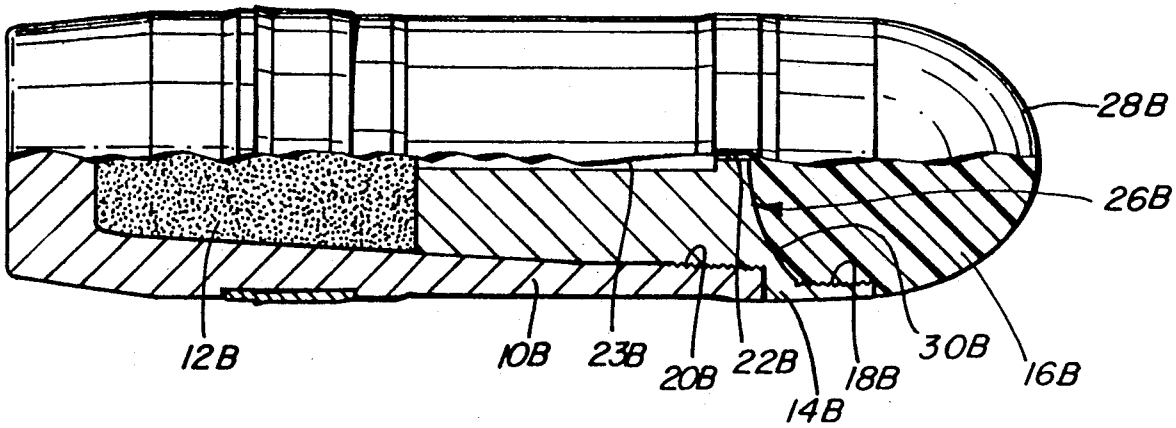
FIG. 6 is a side elevation, partly in section, of yet another embodiment of a 5"/54 calibre radar-augmented target projectile (Model No. BA480) according to the invention.

FIG. 6 illustrates yet another embodiment of the target projectile of the invention (BA480S) which also comprises a modified 5"/54 calibre Mk 64 BL&P hollow cylindrical projectile body 10B, filled with inert filler 12B, such as kaolin/wax. It will be observed that in this modification the entire tapered nose section of the standard projectile has been removed and filler removed to accommodate the larger augmentor.

The augmentor assembly is threaded directly into the projectile body 10B, at 20B and the lens 16B is, in turn, threaded into the base 14B, at 18B.

As in the FIG. 4 embodiment, the base 14B includes a central bore 22B. The bore is filled with a suitable adhesive which, as with the previous embodiments, provides a continuous film of adhesive from the threads 18B, along the concave lens receiving surface 26B and through the bore 22B, to hold the lens 16B in position during launch. The adhesive is cured in situ. The base 14B also includes a central cut-out 23B of larger diameter than the bore 22B.

With respect to the BA480S lens per se, it too is a prolate spheroid having a front ellipsoidal refracting surface portion 28B and a rear reflecting surface 30B, typically silver-plated. The 480 designation indicates a lens diameter of about 4.8 inches and "S" denotes polystyrene.

Figure 7:
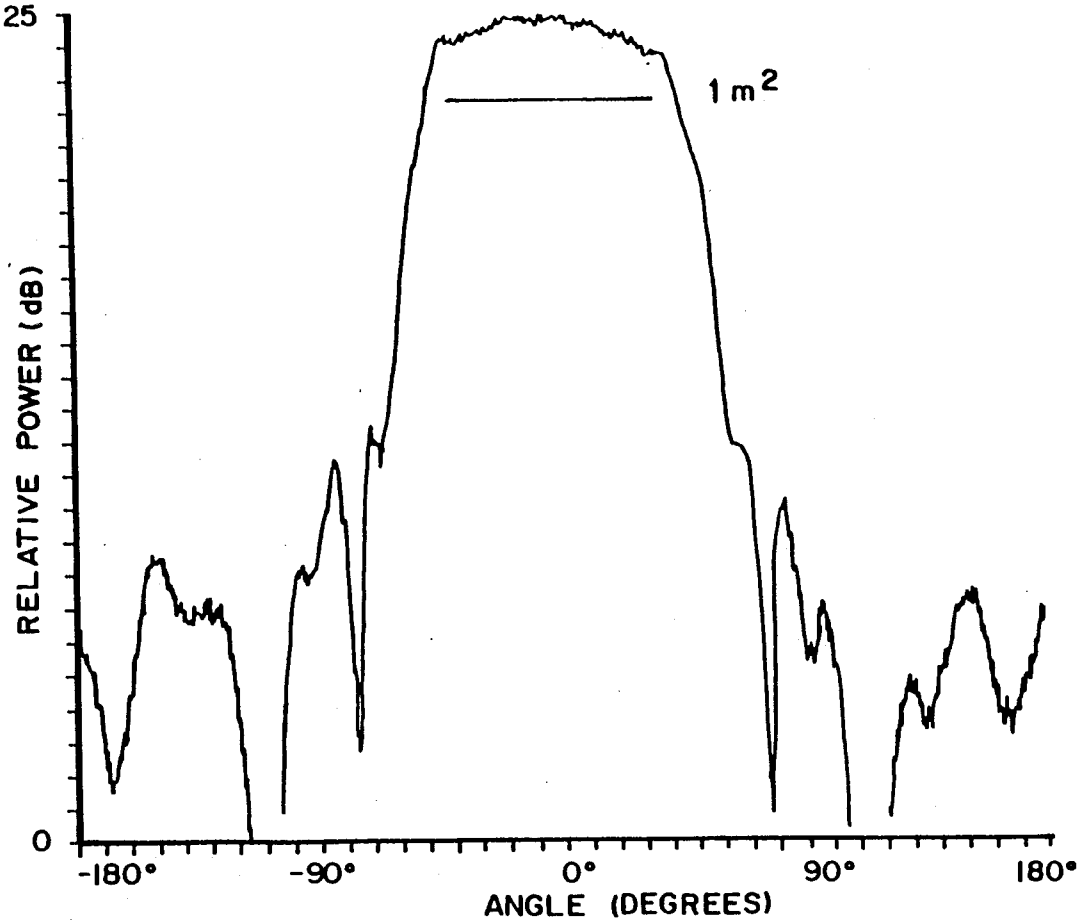
FIG. 7 is a radar cross-section (frontal x-band) of the radar-augmented target projectile illustrated in FIG. 6.

The radar cross-section of the FIG. 6 embodiment (frontal x-band, frequency 9.37 GHz, polarization vertical-vertical) is illustrated in FIG. 7. It is observed that the average RCS of about 2 $m^2$, i.e. about 3 dB above the 1 $m^2$ calibration line is linear over about ±40 degrees from the lens centre line 0, i.e. the longitudinal axis of the projectile.

Figure 8:
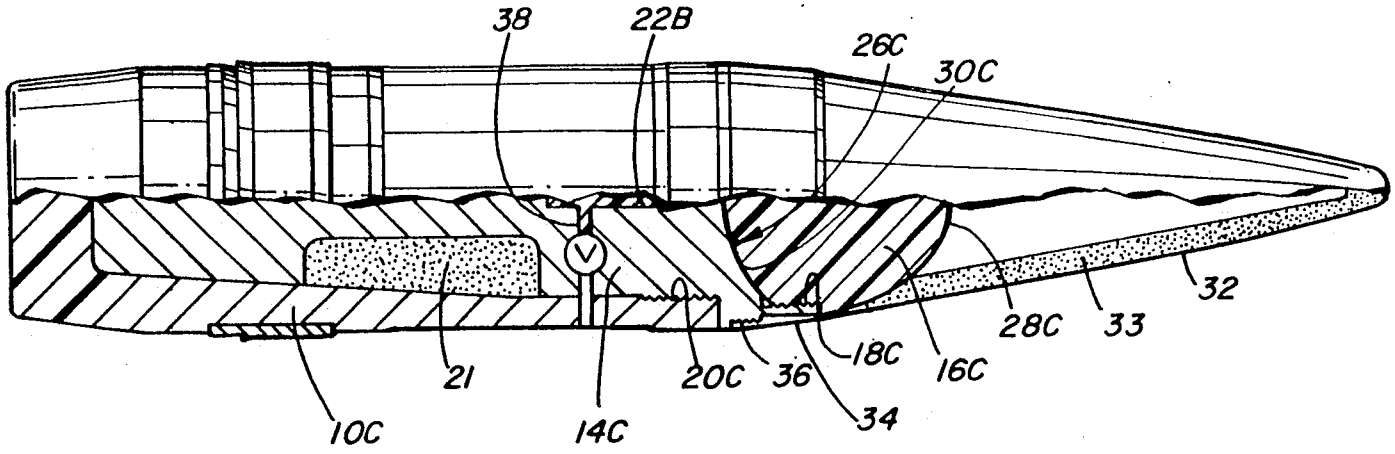
FIG. 8 is a side elevation, partly in section, of a further embodiment of a 5"/54 calibre radar-augmented target projectile (Model No. BA450), including an aerodynamic radome, according to the invention.

The final embodiment of the radar augmented target projectile according to the invention is illustrated in FIG. 8 (BA450SR), which comprises the same modified projectile body as the BA480S projectile described above.

The radar augmentor assembly is threaded into the body 10C at 20C and the lens 16C is threaded into the augmentor base 14C, at 18C. Prior to assembly of lens 16C in base 14C, both the lens and concave lens receiving surface 26 are coated with adhesive. The adhesive is cured in situ after assembly of the augmentor. It is noted that the augmentor assembly occupies most of the hollow body interior, i.e. the inert filler is completely replaced except for air space 21.

An aerodynamic ogive-shaped radome 32 is held in position by a retaining ring or collar 34 which is screwed into the base 14C, at 36. The radome is conveniently made of fibre reinforced plastic such as epoxy and Kevlar ® and the collar is made of AISI 4140 steel.

A foam liner 33 was added to the finished fibre reinforced plastic (FRP) radome using a foam-in-place two element polyurethane foam. The average density attained was 6 lb/ft$^3$. The foam liner does away with the necessity for reinforcing ribs and aluminum nose cups.

In this embodiment, the bore 22C is filled with adhesive and is connected to a lateral passage 38 which permits escape of surplus epoxy when the lens is threaded into the base and ensures a continuous void-free film of adhesive between the lens and base. This also avoids having to drill a long longitudinal bore.

With respect to the BA450SR lens its prolate spheroid shape is defined by a front ellipsoidal refracting surface portion 28C and a rear reflecting surface 30C, typically silver-plated. The 450 designation indicates a lens diameter of about 4.5 inches. "S" denotes polystyrene and "R" that a radome is employed.

Figure 9:
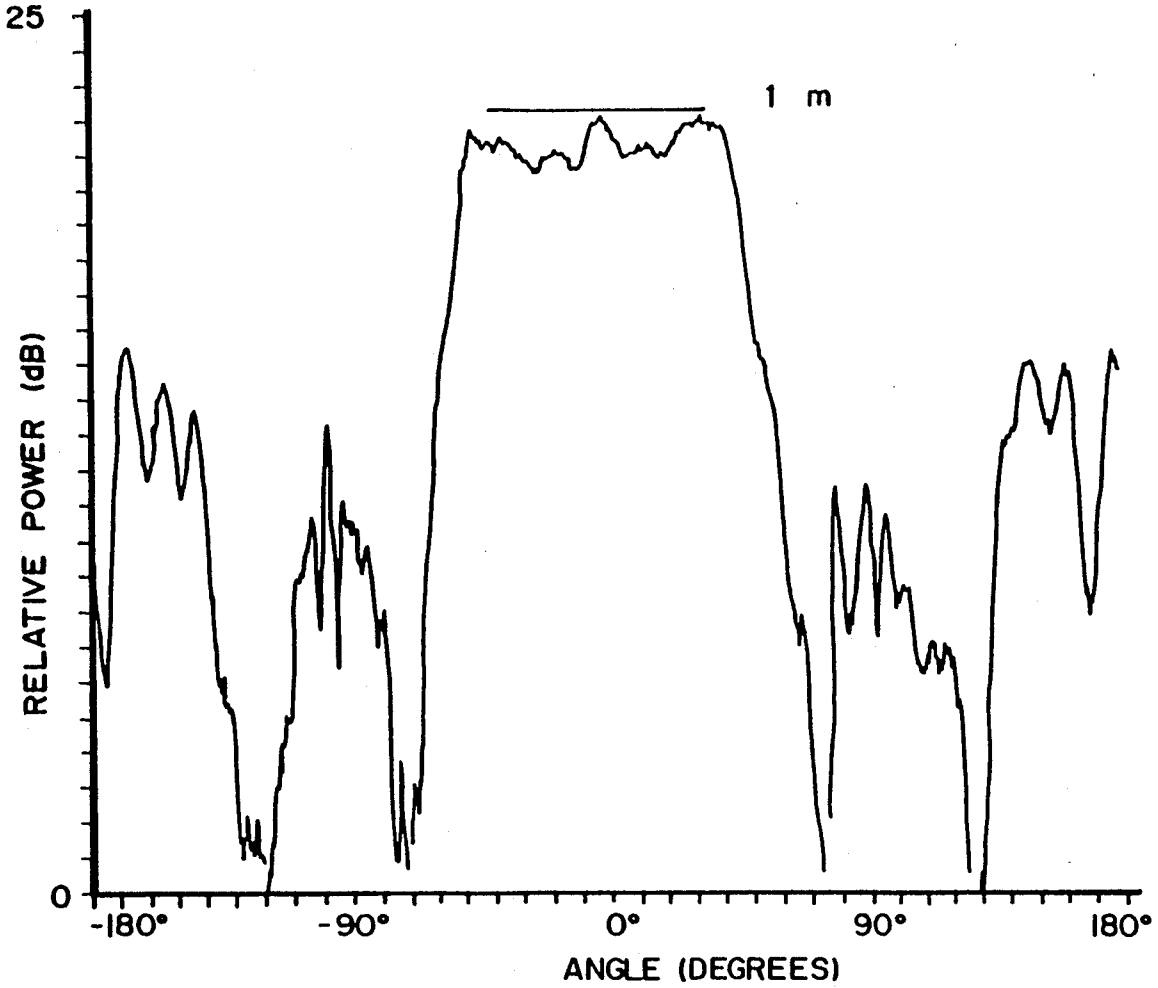
FIG. 9 is a radar cross-section (frontal x-band) of the radar-augmented target projectile illustrated in FIG. 8.

The radar cross-section of the FIG. 8 embodiment (frontal x-band, frequency 9.37 GHz) is illustrated in FIG. 9. The radar cross-section is seen to be essentially linear over about ±45 degrees from the centre line 0, at approximately 0.8 m$^2$, about 1 dB below the 1 m$^2$ calibration level. By way of further explanation, the combined radome and foam liner cause approximately 3 dB loss which is a 50% reduction in RCS. Hence the BA480 without a radome would have a 2 m$^2$ RCS which becomes about 1 m$^2$ with the radome.

As indicated above, the different augmentor base configurations are required to match the weight and centre of gravity of the modified projectile with that of the original unmodified projectile to ensure aerodynamic flight stability.

Thus, the four embodiments of the projectile according to the invention simulate airborne threats bearing radar cross-sections in the range of 0.1 m$^2$ to 2 m$^2$ over about ±45 degrees to the longitudinal axis of the projectile at x-band.

Figure 10:
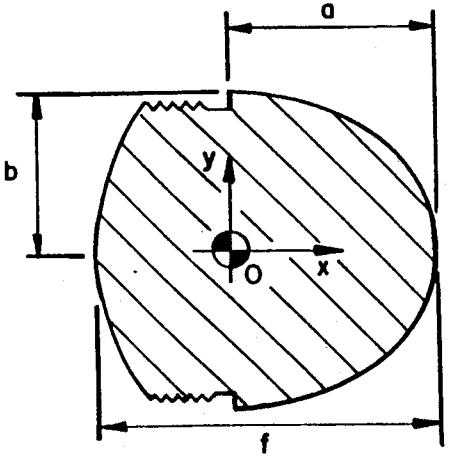
FIG. 10 is a side elevation of a typical prolate spheroid lens element (Model No. 240) according to the invention.

The design of the prolate spheroid reflecting lenses (see FIG. 10) is based upon the following mathematical considerations. Taking the centre of the lens as the origin 0, the refracting (front) ellipsoidal surface of a uniform dielectric lens according to the invention may be defined, in Cartesian co-ordinates x and y, by $$y = \sqrt{b^2 - (b/a)^2 x^2}\,, \quad \text{where } (x,y) \text{ are front surface co-ordinates.}$$

Similarly, the reflecting (rear) surface may be defined as the locus of the normal to the front surface, at a distance f, the focal length, where $$a = nf/(n+1) \qquad (a \text{ is the lens semi-major axis})$$

-continued $$b = a\sqrt{1 - n^{-2}} \qquad (b \text{ is the lens semi-minor axis} = \text{lens radius})$$

$$n = \sqrt{D_K} \qquad (n \text{ is the index of refraction, } D_K \text{ is the dielectric constant})$$

Once the material has been chosen for the lens a coupon is removed from each end of the commercially available bar stock and its electro/optical properties determined. The lens is then machined on numerically controlled machines according to the prescribed formula substituting in the values for the index of refraction and the dielectric constant. It is of interest to note that depending on the material these two values can make a significant change to the shape of the exposed portion of the lens extending from the projectile which in turn effects the overall projectile design. This will be evident shortly. Once the lens has been machined, the rear surface of the lens is metallized, e.g. an aluminum foil is bonded to the (rear) surface. This completes the lens.

The lens must now be adapted to the projectile. In the case of the BA240 design, which is by far the simplest, the lens is attached mechanically through threads to a base which in turn is threaded into a non-modified 5"/54 MK64 blank loaded and plugged (BL & P) projectile. This is a practice round and the cavity normally used to contain high explosives (HE) is filled with an inert filler material. This material must be of the same density as the HE so that the mass and centre of gravity of the projectile remain the same. The lens and base combination are the same weight as the training fuse in the MK64 BL & P or the same as a real fuse in an HE round. With the mass and centre of gravity of the radar augmented projectile matched to the original projectile, its trajectory will also be matched. Also, by matching the weight the standard propelling charge can be used. This is significant as no special charges have to be inventoried for these rounds and there is no risk of overpressuring the barrel due to heavier than normal projectiles.

Lens Materials

Four candidate lens materials of a low loss, low dielectric constant material were considered, specifically, Telfon ®, TPX ®, polystyrene, and high density polyethylene. Structural test firings were made using each material, and RCS measurements were taken with 3.6-inch diameter TPX ®, polystyrene and polyethylene lenses.

The physical, eletro/optical and environmental properties of the four materials selected are presented in Table 1.

Teflon ®, a trademark for polytetrafluoroethylene, has the lowest dielectric constant and dissipation factor of any material surveyed. In comparison with polystyrene lenses, the Teflon ® lenses produced about 2 dB greater radar cross-section for both the 2.4 and 4.5-inch diameter lenses. Two dB is a factor of approximately 1.6. Teflon ® is the most dense and most expensive and its specific tensile strength (tensile strength divided by density), at 25,000 inches is the lowest of the four choices. It is essentially impervious to all environmental hazards, and widely available.

TPX ®, a trademark for polymethylpentene polymer, is a relatively new, little known plastic, with electrical properties very similar to those of Telfon ®, very low density and good, but not well documented physical properties. The data in the table have been substantiated by tensile tests. Its specific tensile strength, a measure of resistance to acceleration induced stress, is 115,000 inches, almost five times that of Teflon ®. Its cost is moderate, about the same as polystyrene.

TABLE 1

| Physical Properties | Teflon | TPX | H.D. Poly-ethylene | Polystyrene |
|---|---|---|---|---|
| Specific Gravity (g/cc) | 2.14–2.2 | 0.83–0.84 | .94–.96 | 1.04–1.09 |
| Tensile Strength (psi) | 2000/ | 3500 | 3100 | 5000 |
| Elongation % | 200/400 | 10–50 | 20–1000 | 1–2.5 |
| Compressive Strength (psi) | 1700 | 5000 | 2700 | 11,500 |
| Flexural Strength | — | 4000 | — | 8000 |
| Izod (ft-lb/in) | 3.0 | .3–1.0 | .5–20 | .25–.4 |
| Tensile Modulus $10^6$ psi | .58 | 1.6 | 0.6 | 4.0 |
| Compressive Modulus $10^6$ psi | — | 1.14 | — | — |
| Flexural Modulus $10^6$ psi | — | 1.1 | 1.0 | 4.0 |
| Electro/Optical Properties | | | | |
| Dielectric Constant 1 mHz | 2.1 | 2.12 | 2.32 | 2.55 |
| Dissipation Factor 1 mHz | .0002 | .00007 | <.0005 | .0001 |
| Refractive Index | 1.35 | 1.465 | 1.54 | 1.59 |
| Environmental Properties | | | | |
| Water Absorption, % 24 hrs | .03 | .01 | .01 | .03 |
| Effect of Sunlight | none | crazes | crazes | slight |
| Effect of Weak Acids | none | none | very resistant | none |
| Effect of Strong Acids | none | slow | slow | attacked |
| Effect of Weak Alkalies | none | none | very resistant | none |
| Effect of Strong Alkalies | none | very resistant | very resistant | none |
| Effect of Organic Solvents | none | chlorin-ated aromatics | resistant below 80 deg C. | aromatic & chlorin-ated hydro-carbons |

Polystyrene is the traditional material used for microwave dielectric applications. The particular brand used here, Rexolit ® 1422, meets US Federal Specification L-P-516a Type E2 (formerly MIL-P-77C-E2). At 132,000 inches, its specific tensile strength is the best of the four materials surveyed.

Polyethylene is cheap and universally available. Its electrical properties are close to those of polystyrene, and its environmental resistance is good. Its specific tensile strength is about 90,000 inches.

The structural test firings indicated that all four materials would be potentially suitable for the ballistic lens. All survived the gun firings with no apparent distortion, and no structural failures. Firings were made at the reasonably representative normal temperature extremes of +40° C. (Series 1) and −20° C.

The radar cross-section of ballistic lenses made with three of the four materials, TPX ®, polystyrene and H.D. polyethylene were found to be quite similar. TPX ® provides about 1½ dB stronger return than polystyrene, but the angular range is somewhat less at ±48degrees as compared to ±56 degrees. Polyethylene gives about the same return as TPX ® at ±52 degrees angular range. The theoretical return for a 3.6-inch diameter lens, using the flat plate formula is 0.53 $m^2$, or −2.8 dB relative to the 1 $m^2$ calibration level of 20 dB relative power. All of the lenses tested exceed this value.

All lenses passed the initial structural test review, and there appeared to be no essential difference in RCS performance amongst the three favoured candidates. However, Rexolit ® 1422 polystyrene exhibits the largest structural safety margin.

Base Materials

The base is conveniently constructed of mild steel to be compatible with AISI 1020 and 1045.

Structural Proofing Trials

The various types of radar-augmented target projectiles were successfully test fired using a 5"/54 calibre OTO-MELERA gun mount and tracked for ballistic purposes by radar.

Compatability With Existing Weapon System:

To establish the ability of the radar-augmented target projectiles to pass through the OTO-MELERA feed system, a preliminiary study indicated the following:

(a) Type BA240—This type of round configuration will pass through the OTO-MELERA lower and upper hoist system.

(b) Type BA450SR (with a Radome)—The radome tested will pass through the hoist system. The fuze setter pawls have been removed to allow successful passage of this type of target.

(c) Types BA360 and BA480—The tests indicated that these types of rounds can be hand loaded. While it takes a high degree of physical effort to hand load these rounds, they are included in the trial to obtain M-22 radar performance tracking information (particularly using the 2 $m^2$ RCS augmentor).

No physical damage to the ship's gun or mounting is anticipated as the projectile targets have been successfully test fired using a land-based mount.

Series 1, as fired, included ten firings, although 21 projectiles were provided. The firings were conducted at essentially horizontal quadrant elevation (QE), with the gun aimed at a butt target some 1000 m from the muzzle. Instrumentation included smear and high speed framing cameras, muzzle doppler and chamber pressure. The firings included one each of the Telfon ®, TPX ®, polyethylene and polystyrene BA240 and BA360 projectiles, and one each polyethylene and polystyrene BA480 projectiles. Photographs obtained for each firing confirmed that all rounds survived with no visible deformation. The mean air temperature during the trials was between 35° C. and 40° C.

Aerodynamic and RCS Proofing Trials:

Series 2 was conducted in three steps, primarily because of weather problems. A total of 20 rounds were fired. Mean air temperature during the trials was between 0° C and −30° C. The first sequence of shots was fired at horizontal QE in order to obtain measurements of the shock wave pattern produced by the three blunt nose augmented projectiles. This sequence of firings also included the first test of a BA450SR projectile, with an 0.030-inch thick FRP radome. Smear photographs and the shock (N-wave) observations confirmed that all augmented projectiles, including the BA450SR radome projectile, survived the gun firings with no visible damage.

The second set of firings under Series 2 was conducted at various quadrant elevations, such that all projectiles fired would have an approximate range of 12,000 m. This range was selected for safety and best fall of shot observations. The radar was placed approximately one km behind the gun on the gun line so that the trajectory of each round could be observed. Firings included two BL&P warmers, three BA240S, four BA360S, and three BA480S. All firings were observed on radar, and impact was observed within the predicted fall of shot area. Some rounds were recovered with the lenses and projectile bodies in remarkably good condition. Coded stakes were placed in the ground to mark the impact point for future triangulation for fall of shot.

Sea Trials (Series 3)

The final set of firings under Series 3 was conducted at the same nominal range as Series 2, but the radar was placed 5 km forward of the impact area, so that the inflight RCS return could be observed, along with trajectory information. Rounds fired included two BL&P warmers and two each BA240S, BA360S, BA480S and BA450SR radome rounds. All projectiles were observed by the radar; the radar cross-section was noted by recording the automatic gain control (AGC) output, and comparing it with a standard 1 $m^2$ spherical calibration target balloon, tethered at a known distance from the radar dish.

A summary of additional proof-of-concept trials is as follows.

A total of 29 firings were conducted using radar augmented projectiles.

A critique of the rounds fired was as follows: 9 of BA240, 10 of BA360, 7 of BA480 and 3 of B450R.

The lens material used on the various types was as follows:

| | |
|---|---|
| BA240 | - high density polyethylene |
| | - polystyrene teflon |
| | - teflon |
| | - polymethylpentene polymer (TPX); |
| BA360 | - high density polyethylene |
| | - polystyrene |
| | - teflon |
| | - TPX; |
| BA480 | - high density polyethylene |
| | - polystyrene; and |
| BA450R | - polystyrene |
| | - radome. |

In all cases the structural integrity of the lens material used was satisfactory.

In all cases the RCS of the different lens material under dynamic gun launched conditions were detectable with a tracking radar.

When considering the cost for lens material, structural integrity, electro/optical properties and availability, the most preferred materials are polystyrene and high density polyethylene. Polystyrene provides the best all-round characteristics for gun launched radar augmented projectiles with the following exception. It is expensive, relatively hard to obtain in large diameters and is easily marked up during normal handling. On the other hand, high density polyethylene is the cheapest of all materials tested, easiest to obtain and capable of rough handling. However, for a given diameter, polystyrene produces the larger RCS. Where the latter is paramount, polystyrene should be used and when it is cost, polyethylene.

Three material combinations for the radome used with the FIG. 8 embodiment were tested satisfactorily. The best results from the viewpoint of minimizing RCS loss has come from a radome made with three layers of 0.010 inch thick kevlar and one of 0.005 inch thick fiberglass in the base area, and two layers of 0.010 inch thick kevlar and one of 0.005 inch thick fiberglass near the apex. This type of construction provides a reasonably constant thickness to radius ratio for optimum strength, yet minimizes the wall thickness near the centre. The peak RCS from this type of construction provided about 1 $m^2$ in the region between $\pm 30$ degrees and $\pm 45$ degrees from the axis, and between 2 and 3 dB below 1 $m^2$ in the core region, $\pm 30$ degrees. The effect of the foam is minimal, causing the 2 dB loss at $\pm 10$ degrees. This type of construction and the use of kevlar, which is clearly more effective than fiberglass from the standpoint of minimizing RCS loss, is preferred.

The invention is applicable to any projectile calibre. The maximum radar cross-section achievable in a different calibre will be 2.0 $m^2$ times the fourth power of the diameter ratio. In 155mm and 105mm calibres, for example, the maximum RCS at x-band will be approximately 4.5 $m^2$ and 1 $m^2$ respectively without ballistic match, and 2.25 $m^2$ and 0.5 $m^2$ with ballistic match.

Principal attention has been given to X-band radar energy, and all designs presented have been evaluated at this frequency. It should be noted, however, that the radar cross section echo of a passive reflector varies inversely with the square of the wavelength of the incident radar beam, thus the RCS of a typical augmentor will increase with increasing radar frequency. The nominal wavelength of an X-band radar beam is 0.032 m, whereas those of Ku and K-band are taken here as nominally 0.02 m and 0.014 m respectively.

The radar-augmented target projectiles may be loaded automatically, or by hand in either Naval or Army guns. Some automatic loading assistance may be necessary for the rounds where the ogive is different from the standard projectile, and where the automatic loader has a sensor pawl which contacts the projectile near the fuze base.

The embodiments of the invention in which an exclusive property or privilege is claimed are defined as follows:

1. A radar augmentor assembly for use in a gun-launched target projectile to increase the frontal radar cross-section of the target projectile to simulate an actual airborne threat on radar while maintaining aerodynamic flight stability, comprising a base member, a uniform dielectric lens attached to said base member and a resilient support means between said base member and said lens which prevents spalling of the lens due to stresses induced during gun-launching, wherein said dielectric lens is configured to provide a frontal radar return echo which simulates that of the actual airborne threat on radar, and wherein said resilient support means is in the form of a continuous film of a suitable resilient thermosetting resin material.

2. A target projectile according to claim 1, wherein the base member includes a central longitudinal bore extending therethrough and wherein said bore is filled with said thermosetting resin material.

3. A target projectile according to claim 2, wherein said thermosetting resin material is an epoxy resin.

4. A target projectile according to claim 3, wherein said uniform dielectric lens is a prolate spheroid having a front ellipsoidal refracting surface and a rear reflecting surface.

5. A target projectile according to claim 4, wherein the front refracting surface is defined in Cartesian co-ordinates, x and y, and taking the centre of the lens as the origin, by $$y = \sqrt{b^2 - (b/a)^2 x^2}\text{, where } (x,y) \text{ are front surface co-ordinates.}$$

6. A target projectile according to claim 5, wherein the rear reflecting surface is defined as the locus of the normal to the front surface, at a distance f, the focal length, where $$a = nf/(n + 1)$$

$$b = a\sqrt{1 - n^{-2}}$$

$$n = \sqrt{D_K}\text{, wherein}$$

$a$ is the semi-major axis of the lens;
$b$ is the semi-minor axis of the lens;
n is the index of refraction; and
$D_K$ is the dielectric constant.

7. A target projectile according to claim 6, wherein the dielectric lens material is selected from the group consisting of high density polyethylene, polystyrene, polymethylpentene polymer and polytetrafluoroethylene.

8. A target projectile according to claim 6, wherein the dielectric lens material is selected from high density polyethylene and polystyrene.

9. A target projectile according to claim 8, wherein the calibre of the projectile is 5 inch.

10. A target projectile according to claim 9, wherein the diameter of the lens is about 2.5 inches and provides a frontal radar cross-section at x-band of about 0.2 $m^2$.

11. A target projectile according to claim 9, wherein the diameter of the lens is about 3.6 inches and provides a frontal radar-cross section of about 0.63 $m^2$.

12. A target projectile according to claim 9, wherein the diameter of the lens is about 4.8 inches and provides a frontal radar cross-section of about 2 $m^2$.

13. A target projectile according to claim 9, wherein the diameter of the lens is about 4.5 inches, and additionally comprising an ogive-shaped aerodynamic radome covering the radar augmentor assembly to provide a frontal radar cross-section of about 1 $m^2$.

14. A radar augmentor assembly for use in a gun-launched target projectile to increase the frontal radar cross-section of the target projectile to simulate an actual airborne threat on radar while maintaining aerodynamic flight stability, comprising a base member including a recess having a threaded upper portion and a contiguous concave lower portion, a uniform dielectric lens having a front ellipsoidal surface portion, a rear convex reflecting surface portion and a threaded middle portion therebetween, attached to said base member such that substantially the entire threaded portion and the convex and concave portions of the lens and base members, respectively, are in close proximity to each other, and a continuous film of a suitable resilient thermosetting resin material extending between substantially the entire proximate portions of said lens and base members.

15. A target projectile according to claim 14, wherein said base member includes a central opening in said concave lower portion and a longitudinal bore extending from said opening through said base member, and wherein said base is filled with the thermosetting resin material.

16. A target projectile according to claim 15, wherein said thermosetting resin is an epoxy resin having a minimum tensile yield strength of about 4000 psi.

17. A target projectile according to claim 16, wherein the dielectric lens material is selected from high density polyethylene and polystyrene.

* * * * *